United States Patent [19]

Sickler

[11] 4,129,393

[45] Dec. 12, 1978

[54] SCAFFOLD LUMBER CLAMPS

[76] Inventor: Jack R. Sickler, P.O. Box 20803, Billings, Mont. 59104

[21] Appl. No.: 818,815

[22] Filed: Jul. 25, 1977

[51] Int. Cl.[2] ..... E04G 7/00

[52] U.S. Cl. ..... 403/49; 24/263 A; 403/391; 403/396

[58] Field of Search ..... 403/49, 391, 394, 396, 403/400, 403, 405, 410; 24/81 CR, 263 A; 52/645, 646, 648; 182/179

[56] References Cited

U.S. PATENT DOCUMENTS 1,538,595 5/1925 Schroeder ..... 182/179 X

FOREIGN PATENT DOCUMENTS 965188 2/1950 France ..... 403/394
133536 11/1951 Sweden ..... 403/394
633345 12/1949 United Kingdom ..... 403/396

*Primary Examiner*—Wayne L. Shedd
*Attorney, Agent, or Firm*—Clarence A. O'Brien; Harvey B. Jacobson

[57] ABSTRACT

A pair of scaffold lumber clamps are provided. A first of the clamps includes a pair of elongated generally parallel strap members with adjustable clamp structure connected between corresponding ends thereof for drawing the strap members toward each other for clamping lumber pieces therebetween. The opposing sides of the strap members include pointed projections projecting outwardly therefrom. The second clamp structure includes an angle member having a pair of elongated upstanding and generally right angularly disposed integral flanges. The angle member may embracingly engage a corner of an upright piece of lumber and an elongated bar member generally parallels the outer side of a first flange of the angle member and first clamp structure is connected between that flange and the bar for drawing the bar toward the flange. A second bar generally parallels and opposes the inner side of the second flange and second clamp structure is operatively connected between the angle member and the second bar for drawing the latter toward the second flange. Also, the second clamp includes a third bar generally paralleling and opposing the side of the second bar remote from the second flange and the second adjustable clamp structure is also operative to draw the third bar toward the second flange and the second bar.

7 Claims, 7 Drawing Figures

SCAFFOLD LUMBER CLAMPS

BACKGROUND OF THE INVENTION

Various forms of clamp structures and other devices have been heretofore provided for the purpose of securing overlapped and adjacent lumber pieces together in order to form a scaffold. However, most of these previous devices are difficult to handle, expensive and sometimes not reliable. Accordingly, a need exists for simple structures by which overlapped and adjacent scaffold lumber pieces may be quickly and effectively anchored relative to each other.

Examples of previously known clamps for securing intersecting scaffold members and other clamps including some of the general structural and operational features of the instant invention are disclosed in U.S. Pat. Nos. 437,935, 578,217, 706,185, 1,060,914, 1,468,478, 2,185,948 and 2,635,717.

BRIEF DESCRIPTION OF THE INVENTION

The scaffold lumber clamps of the instant invention are constructed in a manner whereby overlapped scaffold lumber sections may be readily clamped together. One of the clamps is specifically designed for the purpose of anchoring oppositely angled and overlapped central portions of diagonal bracing members together and the second clamp is specifically designed to clamp the ends of horizontal and diagonal members to upright scaffolding members.

The main object of this invention is to provide lumber clamps which may be readily used to construct scaffolds.

Another object of this invention is to provide lumber clamps which may be utilized to erect different forms of scaffolds and which will also be operative to secure lumber pieces together in order to form a scaffold erected upon uneven ground.

Another important object of this invention is to provide lumber clamps which may be readily utilized to erect irregular staging to support a ramp.

Yet another very important object of this invention is to provide lumber clamps in accordance with the preceding objects and which may be readily constructed from materials which may be purchased economically.

Another object of this invention is to provide clamp structures in accordance with the preceding objects and which will be dependable in operation.

A further important object of this invention is to provide clamp structures which may be readily utilized even by inexperienced persons.

A final object of this invention to be specifically enumerated herein is to provide lumber clamps which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
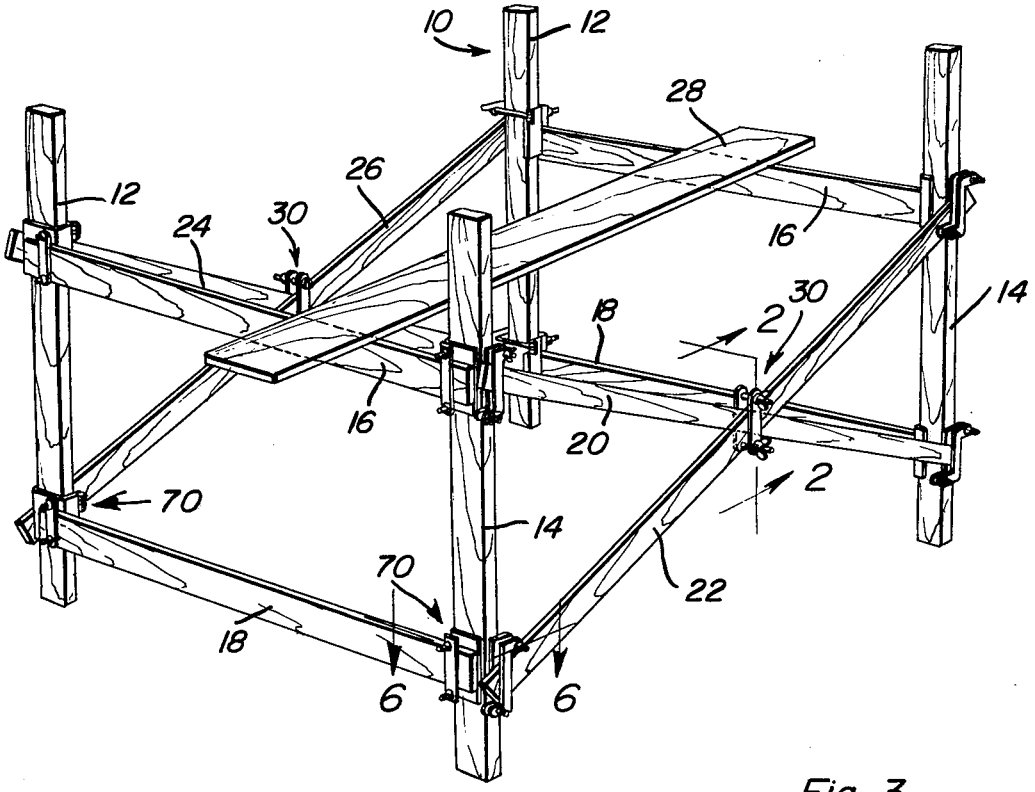
FIG. 1 is a perspective view of a simple scaffold construction whose various lumber pieces are joined together through the utilization of the two clamps of the instant invention.
Figure 2:
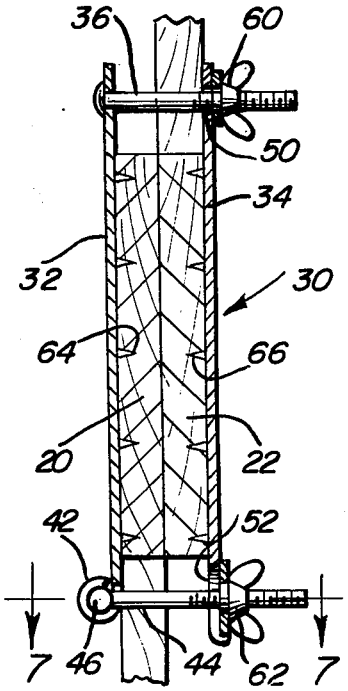
FIG. 2 is an enlarged, vertical, sectional view taken substantially upon the plane indicated by the section line 2—2 of FIG. 1.
Figure 3:
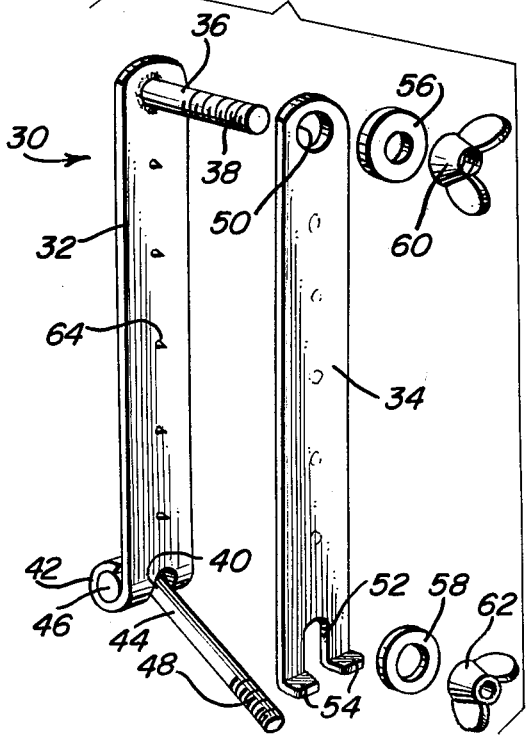
FIG. 3 is an exploded, perspective view of the clamp illustrated in FIG. 2.
Figure 4:
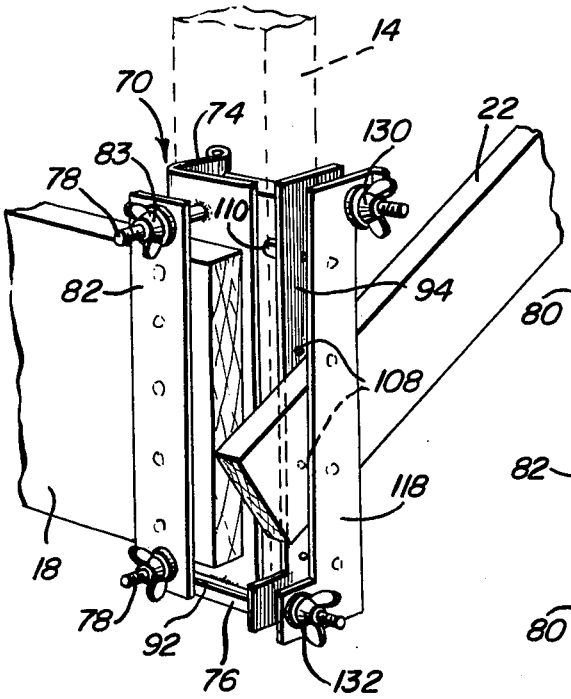
FIG. 4 is an enlarged, fragmentary view of the lower portion of the near corner of the scaffold illustrated in FIG. 1 and with the upright corner piece thereof being illustrated in phantom lines.
Figure 5:
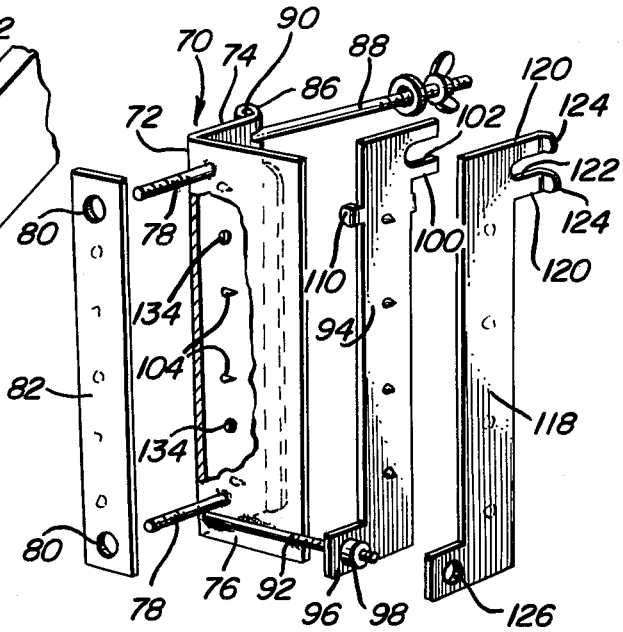
FIG. 5 is an exploded, perspective view of the clamp illustrated in FIG. 4 and with a portion of the angle member thereof being broken away and illustrated in vertical section.
Figure 6:
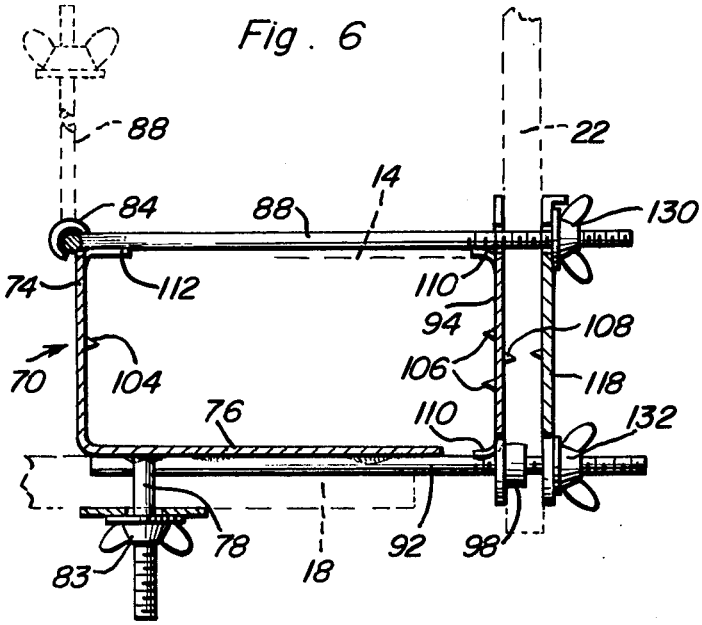
FIG. 6 is an enlarged, horizontal, sectional view taken substantially upon the plane indicated by the section line 6—6 of FIG. 1.
Figure 7:
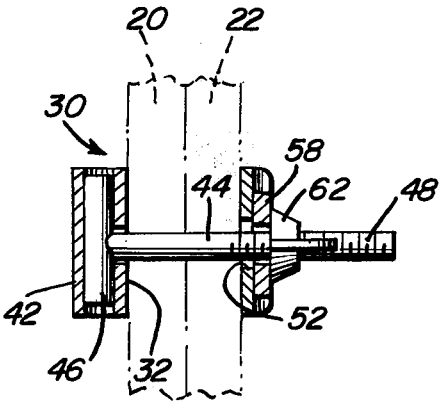
FIG. 7 is an enlarged, horizontal, sectional view taken substantially upon the plane indicated by the section line 7—7 of FIG. 2.

With reference now more specifically to FIG. 1, there may be seen a simple form of scaffold referred to in general by the reference numeral 10. The scaffold 10 includes two pairs of opposite side end uprights 12 and 14 and each pair of corresponding end uprights 12 and 14 has a pair of upper and lower horizontal transverse members 16 and 18 secured therebetween. In addition, the uprights 14 have a first pair of crossed diagonal braces 20 and 22 secured therebetween and the uprights 12 have a second pair of crossed braces 24 and 26 secured therebetween. A horizontal support member 28 extends between and is supported from the upper edges of the transverse members 16.

With attention now invited more specifically to FIGS. 1, 2, 3 and 7, a clamp assembly referred to in general by the reference numeral 30 is utilized to clamp the overlapped midportions of the crossed diagonal members 20 and 22 together. The clamp assembly 30 includes a pair of elongated rigid strap members 32 and 34 and the strap member 32 has a first shank 36 secured thereto and projecting outwardly of the side of the strap member 32 opposing the strap member 34. The outer end of the first shank 36 is externally threaded as at 38 and the remote or lower end of the strap member 32 is longitudinally slotted as at 40 and rolled outwardly as at 42 to define a journal. A second shank 44 is provided and includes a cylindrical cross head 46 on one end journaled in the journal 42 and with the shank 44 slidably received in the slot 40. The end of the shank 44 remote from the cross head 46 is externally threaded as at 48 and the end of the strap member 34 opposing the shank 36 has an aperture 50 formed therethrough in which the shank 36 is slidably received. The opposite end of the strap member 34 includes an endwise outwardly opening notch 52 formed therein in which the free swingable end of the second shank 44 is swingably seated. The opposite side portions of the slotted end of the strap member 34 define furcations and the free ends of the furcations are turned outwardly as at 54 to define abutment flanges. Washers 56 and 58 are disposed over the end portions of the shanks 36 and 44 projecting through the aperture 50 and the notch 52 and threaded wing nut abutments 60 and 62 are captively threaded on the shanks 36 and 44 outwardly of the washers 56 and 58, the outturned portions 54 serving to maintain the washer 58 and the wing nut 62 against displacement outwardly of the corresponding end of the strap member 34. Thus, the second shank 44 is maintained within the notch 52.

From FIG. 1 of the drawings, it may be seen that the clamp assembly 30 is utilized to clamp the overlapped midportions of the diagonal braces 20, 22 and 24, 26 together. In addition, the opposing sides of the strap members 32 and 34 include outwardly projecting pins or sharpened projections 64 and 66 for biting into the remote sides of the braces 20, 22 and 24, 26.

With reference now more specifically to FIGS. 1, 4, 5 and 6, a second clamp assembly is referred to in general by the reference numeral 70. The clamp assembly 70 includes an upstanding angle member 72 including generally right angulated intergral flanges 74 and 76. The outer excluded angle side of the flange 76 has a pair of outwardly projecting threaded bolts 78 supported therefrom and the outer ends of the bolts 78 are slidingly received through opposite end apertures 80 formed in a rigid bar 82 generally paralleling and opposing the outer surface of the flange 76. Threaded wing nuts 83 are threaded on the end portions of the bolts 78 projecting through the apertures 80 and thereby may be tightened to clamp a piece of lumber such as the lower transverse member 18 between the flange 76 and the bar 82. The side of the bar 82 opposing the flange 76 includes outwardly projecting pins or sharpened abutments corresponding to the pins 64.

The upper marginal portion of the free marginal edge of the flange 74 is slotted and rolled outwardly as at 86 in order to define a slotted journal corresponding to the journal 42. A threaded bolt 88 is provided with a cylindrical cross head 90 on one end thereof rotatably received in the journal 86 and the bolt 88 is received through the slot corresponding to the slot 40. In addition, the lower marginal edge of the flange 76 has a threaded bolt 92 anchored to the outer surface thereof and disposed generally normal to the longitudinal extent of the flange 76. One end of the bolt 92 projects outwardly of the free edge of the flange 76 remote from the flange 74 and a second rigid bar 94 is provided and generally parallels the flange 74. The lower end of the bar 94 includes a laterally offset portion 96 having an aperture formed therethrough and a sleeve 98 secured to the side of the bar 94 remote from the flange 74 over the aperture. The free end of the bolt 92 projecting outwardly of the free marginal edge of the flange 76 is received through the aperture in the lower offset portion 96 and also through the sleeve 98. In addition, the upper end of the bar 94 includes an oppositely directed laterally offset portion 100 having a horizontally outwardly opening notch 102 formed therein and the free swingable end of the bolt 88 is swingably seatable in the notch 102.

The opposing surfaces of the flange 74 and the bar 94 include outwardly projecting pins or sharpened projections 104 and 106 and the side of the bar 94 remote from the flange 74 includes outwardly projecting pins or sharpened projections 108. Still further, the opposite side portions of the upper end of the bar 94 includes positioning ears 110 projecting toward the flange 74 and between which the corresponding edge of the vertical member 14 is embracingly received. In addition, that portion of the free marginal edge of the flange 74 below the outwardly rolled portion 86 includes an inturned abutment flange 112 and the upright member 14 is also received between the abutment flange 112 and the inner surface of the flange 76.

It may also be seen that the clamp assembly 70 includes a third bar 118 which generally parallels the bar 94 outwardly of the latter and is substantially indentically formed, except that the bar 118 does not include outer side pins or sharpened projections corresponding to the projections 108 and the bar 118 does not include a sleeve corresponding to the sleeve 98 or ears corresponding to the ears 110. Further, the furcations 120 defining the notch 122 corresponding to the notch 102 include right angulated free end portions 124 corresponding to the right angulated portions 54 and which are provided for the same purpose. The free end of the bolt 92 is received through the aperture 126 formed in the third bar 118 registered with the sleeve 98 and the free end of the bar 88 is swingable into seated position within the notch 122. Of course, the bolt 88 has a threaded wing nut 130 threaded thereon and the bolt 92 includes a similar threaded wing nut 132 threaded thereon. Accordingly, the wing nuts 83 captively threaded on the bolts 78 are utilized to clamp the adjacent end of the lower transverse member 18 to the upright 14. In addition, the bolts 88 and 92 and the captive threaded wing nuts 130 and 132 are utilized to clamp the upright 114 between the flange 74 and the bar 94 and to also clamp the diagonal brace 22 between the bars 94 and 118.

Further, the flange 74 includes openings 134 formed therethrough to receive nails in the event additional security in the mounting of the clamp 70 on the upright 14 is desired.

It is believed readily apparent that the clamps 70 may be initially clamped to the uprights 14 by tightening the threaded wing nuts 130 and 132 in such a manner to clamp the uprights 14 between the bars 94 and the flanges 74. Thereafter, the upper and lower transverse members 16 and 18 may be clamped in position between adjacent uprights and after the transverse members 16 and 18 have been secured between both pairs of uprights 12 and 14, the diagonal bracing members 20 and 22 may be clamped in position between the corresponding pairs of bars 94 and 118. After the scaffold 10 has been initially erected in this manner, the various lumber pieces thereof may be adjusted as required and the clamp assemblies 70 may be tightened and the clamp assemblies 30 may be applied and tightened.

Further, the clamp assemblies 30 and 70 may be used to erect display booths at fairs, carnivals and exhibits. In such instances, horizontal bracing, as opposed to cross bracing, may be used, if desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A scaffold lumber clamp assembly including an elongated angle member comprising first and second right angularly disposed elongated flanges integrally joined together along adjacent longitudinal edge portions and including inner and outer included and excluded angle sides, respectively, the opposite ends of one of said flanges including a pair of outstanding threaded studs anchored relative thereto and projecting outwardly from the outer side thereof, a first elongated clamp bar paralleling the outer side of said one flange and including opposite end openings formed therein through which said studs are slidingly received, and a pair of first threaded abutment members threadedly engaged on said studs outwardly of the side of said clamp bar remote from said one flange and abuttingly engageable with said clamp bar about said openings, one end of said one flange including a threaded shank anchored relative thereto and projecting endwise outwardly from the corresponding end portion of the longitudinal edge of the one flange remote from the other flange, the end of the other flange remote from said one end of said one flange having one end portion of a threaded bolt pivotally anchored thereto adjacent the free longitudinal edge of said other flange remote from said one flange for swinging of said bolt about an axis generally paralleling the free longitudinal edge and extending transversely of said bolt between a free position generally paralleling said one flange and a second position projecting endwise outwardly of said free longitudinal edge of said other flange and generally paralleling the latter, and second and third inner and outer elongated clamp bars paralleling said second flange and including corresponding first and second ends, said first ends having registered openings formed therein through which the outer free end portion of said threaded shank is slidingly received, a second threaded abutment member threadedly engaged on the outer end of said shank outwardly of said outer clamp bar and abuttingly engageable with the outer side of said outer bar, said second ends of said second and third bars including registered notches formed therein opening laterally outwardly through the longitudinal side edges of said second and third bars corresponding to said free longitudinal edge of said other flange and into which the free end portion of said threaded bolt is receivable when said bolt is swung from said second position to said first portion, and a third threaded abutment member threadedly engaged on the free end portion of said bolt and abuttingly engageable with the side of said outer clamp bar remote from said inner clamp bar.

2. The combination of claim 1 wherein the longitudinal side edge of said second clamp bar adjacent said one flange includes a right angular abutment flange projecting toward said first flange for abutting the same side of a lumber piece against which the inner side of said one flange is abutted.

3. The combination of claim 1 wherein the edge portions of said third clamp bar defining the opposite side outer extremities of the corresponding notch are turned outwardly away from second clamp bar.

4. The combination of claim 1 wherein said threaded bolt includes a base end having a cylindrical cross head anchored thereto, said other flange having a longitudinal slot therein and being coiled to define a generally cylindrical journal, said cross head being rotatably received in said journal with said bolt swingable in said longitudinal slot.

5. The combination of claim 4 wherein said first clamp bar includes longitudinally spaced spikes supported therefrom and projecting toward said one flange.

6. The combination of claim 4 wherein the opposing sides of said second and third bars include outwardly projecting spikes.

7. The combination of claim 1 wherein said first, second and third threaded abutment members are captively threadedly engaged on the corresponding threaded members.

* * * * *